US009844272B1

(12) United States Patent
Vetter et al.

(10) Patent No.: US 9,844,272 B1
(45) Date of Patent: Dec. 19, 2017

(54) LIFT ASSIST SYSTEMS AND METHODS FOR ADJUSTABLE SEATS

(71) Applicant: SEACHROME CORPORATION, Long Beach, CA (US)

(72) Inventors: William Charlie Vetter, Yorba Linda, CA (US); Richard Montoya, Monterey Park, CA (US); Jose Marquez Ortiz, El Monte, CA (US); Ray Kenneth Cano, Los Angeles, CA (US); Samuel Colavin Longo, La Canada, CA (US); Christopher Antonio Pulone, Diamond Bar, CA (US)

(73) Assignee: SEACHROME CORPORATION, Long Beach, CA (US)

( * ) Notice: Subject to any disclaimer, the term of this patent is extended or adjusted under 35 U.S.C. 154(b) by 0 days.

(21) Appl. No.: 15/643,378

(22) Filed: Jul. 6, 2017

Related U.S. Application Data

(60) Provisional application No. 62/489,962, filed on Apr. 25, 2017.

(51) Int. Cl.

| | |
|---|---|
| ***A47C 9/06*** | (2006.01) |
| *A47K 3/28* | (2006.01) |
| *A47K 3/12* | (2006.01) |

(52) U.S. Cl.
CPC ..... *A47C 9/06* (2013.01); *A47K 3/122* (2013.01); *A47K 3/282* (2013.01)

(58) Field of Classification Search
None
See application file for complete search history.

(56) References Cited

U.S. PATENT DOCUMENTS

| | | | | |
|---|---|---|---|---|
| 2,689,599 | A | 9/1954 | Mauser | |
| 4,155,202 | A | 5/1979 | Hartman | |
| 4,575,151 | A * | 3/1986 | Edstrom | A47C 3/026 297/302.6 |
| 4,597,568 | A | 7/1986 | Drexhage | |
| 4,818,019 | A * | 4/1989 | Mrotz, III | A47C 3/026 248/575 |
| 5,136,737 | A | 8/1992 | Reppas et al. | |
| 5,217,316 | A * | 6/1993 | Ojima | E05D 11/06 16/280 |
| 6,908,159 | B2 * | 6/2005 | Prince | A47C 1/023 297/452.15 |
| 7,192,088 | B1 * | 3/2007 | Trombley | B60N 2/3011 297/332 |
| 7,686,389 | B2 * | 3/2010 | Yamada | B60N 2/3013 297/15 |
| 7,878,592 | B2 * | 2/2011 | Yamada | B60N 2/22 297/331 |
| 8,157,326 | B2 * | 4/2012 | Raymond | B60N 2/1695 297/300.3 |
| 2008/0277976 | A1 | 11/2008 | Austin | |
| 2014/0077429 | A1 | 3/2014 | Battey et al. | |

* cited by examiner

*Primary Examiner* — David E Allred
(74) *Attorney, Agent, or Firm* — Fish IP Law, LLC

(57) ABSTRACT

Lift-assist systems for adjustable objects are provided, which could include at least one of an enclosed spring and a substantially flat, elongated torsion spring. Suitable substantially flat springs could be configured to twist and untwist up to between 45-135 degrees when the seat or other object is adjusted between stowed and use configurations. In some preferred aspects, the spring could be made from a tempered steel material.

9 Claims, 7 Drawing Sheets

LIFT ASSIST SYSTEMS AND METHODS FOR ADJUSTABLE SEATS

This application claims priority to U.S. provisional application No. 62/489,962, filed Apr. 25, 2017, titled Folding Seat With Spring. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is adjustable seats, and lift assist systems for adjustable seats and other objects.

BACKGROUND

The background description includes information that may be useful in understanding the present invention. It is not an admission that any of the information provided herein is prior art or relevant to the presently claimed invention, or that any publication specifically or implicitly referenced is prior art.

Some efforts have been placed in providing lift assist systems for adjustable objects. For example, some foldable seats include a lift assist system that allow the seat to be lifted or folded with minimal force, sometimes even automatically, to a stowed position. Unfortunately, many known systems are not suitable for use in bath tubs, showers or other wet environments, and are not ADA (American with Disabilities Act) compliant.

While there are some known seats that are ADA compliant, or suitable for use in tubs and showers, known seats often fail to provide any or sufficient lift-assist, or require external coil springs that could act as pinch points, detract from a sleek and clean looking seat system, and be sensitive to changing temperatures and water conditions.

Thus, there is still a need for improved adjustable seats, and lift assist systems for adjustable seats and other objects.

SUMMARY OF THE INVENTION

The present invention provides a lift-assist system comprising an enclosed spring that is protected from water, heat, and rust. Additionally or alternatively, the lift-assist system could comprise an elongated, substantially flat torsion spring that is configured to twist between 45-135 degrees (e.g., 85-105 degrees) to become fully tensioned.

As used herein, the term "elongated" refers to an object that is at least twice as long as it is wide. For example, an elongated object could have a length that is at least 200%, at least 300%, at least 400%, at least 500%, at least 600%, at least 700%, or even at least 800% greater than its width.

As used herein, the term "substantially" should be interpreted broadly to include objects that are within 15%, or even within 10% or within 5% of the term following "substantially." For example, an object that is "substantially parallel" to a second object will be parallel, or within 13.5 degrees of parallel (calculated as 90 degrees×0.15, with 90 degrees being perpendicular, the opposite of parallel). As another example, the term "substantially flat" could include objects that are flat or have a slight curvature, with 100% referring to a configuration where the two side edges of the object meet to form a tube, and with 15% referring to the curvature of the object when the two edges are lifted to be 15% of the way towards forming the tube.

As used herein the term "elongated, substantially flat torsion spring" includes objects having a length at least twice as long as its width, which is flat or has a slight curvature as set forth above, and is configured to twist such that one end rotates relative to a second end.

In one aspect of the inventive subject matter, a lift-assist system for an adjustable seat is provided. The system comprises (1) a side arm of a frame, (2) a second side arm of a frame, and (3) a cross-member, wherein (a) at least a portion of the cross-member extends between the first and second side arms, and wherein (b) the cross-member includes a lumen sized and dimensioned to receive a length of an elongated torsion spring. The elongated torsion spring will preferably be positioned through the lumen of the cross-member, and be coupled to first and second spring receivers that are each independently coupled to (e.g., welded, movably attached, or permanently attached to) at least one of the cross-member, the first side arm, and the second side arm. Advantageously, the adjustable seat could be configured such that when the adjustable seat moves between first and second configurations (e.g., stowed and use positions), the first portion (e.g., an end portion) of the elongated torsion spring is rotated relative to a second portion, thereby causing the elongated torsion spring to twist between the first and second portions.

For embodiments with enclosed springs (e.g., enclosed within a cross-member), all suitable types of spring are contemplated, although elongated, substantially flat torsion springs are generally preferred. This includes, for example, coil springs, a torque rod assembly as described in US 2008/0277976, a two-bar torsion system as described in U.S. Pat. No. 5,136,737. Preferably the enclosure or cross-member will be made of a material suitable to protect the spring(s) from water and temperature changes.

In another aspect of the inventive subject matter, a lift-assist system for an adjustable seat includes a substantially unenclosed, elongated, substantially flat torsion spring. As the spring will be largely exposed to water, heat, and the environment in such systems, it is generally preferred that the spring will be made of a material that is resistant to temperature changes and water exposure.

There are at least two types of forces used to move the seat, a raising force to a "stowed" configuration, and a lowering force to a "use" configuration. The spring(s) contemplated herein could exert sufficient force to automatically raise the seat to the stowed configuration without any outside assistance, or alternatively could require some outside assistance.

Viewed from a different perspective, the lift assist systems described herein could advantageously bias seats in a stowed configuration, such that minimal or no user force is required to adjust the seat from a use configuration to a stowed configuration. Additionally or alternatively, the lift assist systems described herein could advantageously provide some resistance when the seat is lowered to a use configuration, for example due to a twisting or tensioning of the spring(s), to cause a reduction in the perceived weight of the seat.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
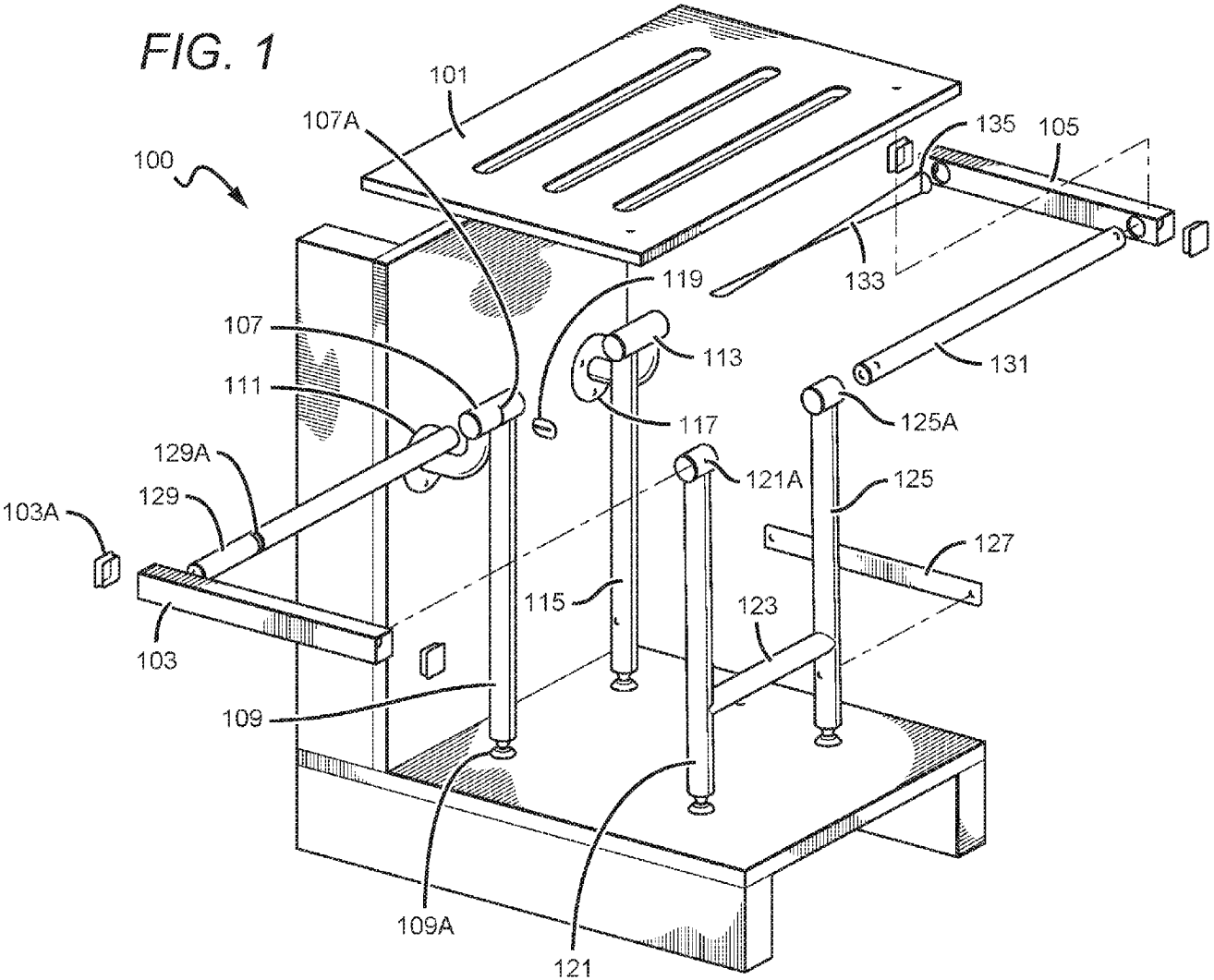
FIG. 1 illustrates an exploded view of a lift-assist adjustable seat system that is wall mounted and includes a lift-assist system of the inventive subject matter.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present invention provides a lift-assist system for an adjustable seat, the lift-assist system comprising an elongated, substantially flat torsion spring that is configured to twist and untwist when the seat moves between stowed and use configurations. In some preferred embodiments, the spring is made from a steel material, and is configured to twist when the adjustable seat is lowered, thereby causing tension in the spring while the seat is in use. Such resistance to lowering the seat assembly causes a reduction in the perceived weight of the seat, and allows the seat to return to an upright or stowed position with little or no effort on the part of the user.

It is contemplated that the spring could be made from any material and have any size and shape such that the spring could twist between 45-135 degrees (e.g., about 90 degrees) when a force is applied, and automatically return to its original untwisted shape when the force is lifted, through multiple uses (e.g., at least 100 uses, at least 500 uses, at least 1000 uses). Preferably an adjustable seat incorporating such a spring and lift-assist system meets or exceeds the minimum 250 pound ADA load requirement when properly installed. Viewed from a different perspective, the seat and lift-assist system preferably supports up to at least 250 pounds, more preferably up to at least 500 pounds or even up to at least 800 pounds, when properly installed.

Contemplated elongated springs could have any suitable length, width and thickness as long as its length is at least twice as large as its width. For example: suitable spring lengths include between 5-45 inches, between 5-35 inches, 5-25 inches, between 5-20 inches, between 10-25 inches, between 5-15 inches, between 10-20 inches, and between 10-18 inches; suitable spring widths include between 0.5-3 inches, between 0.5-2 inches, between 0.5-1.5 inches, and between 0.5-1.25 inches; and suitable spring thicknesses include between 0.01-1.5 inches, 0.01-0.5 inches, 0.01-0.4 inches, 0.01-0.3 inches, 0.01-0.25 inches, between 0.2-1.25 inches, and between 0.25-1 inch. Viewed from a different perspective, the spring size could be, among other things, ⅛"×¾" Spring Steel, ⅛"×½" Spring Steel, 3/32"×3'4" Spring Steel 3/32×½" Spring Steel, 1/16"×¾" Spring Steel, or 1/16"×½" Spring Steel.

The materials (e.g., blue spring tempered steel, heat-treated carbon spring steel, stainless steel) and dimensions could be selected based on, among other things, the overall size of the seat and frame, the overall shape of the seat and frame, the materials used to fabricate the seat top and frame, the weight of the intended users, and the likely frequency of use.

Some elongated springs of the inventive subject matter are enclosed in a cross-member or other portion of a seat frame (e.g., legs, side arms, rear cross-member, front cross-member). One advantage of an elongated torsion bar as described herein is that it requires very little space, can be extremely stiff for its size, and be internal and entirely hidden from view. Although elongated torsion bars are associated with a disadvantageously short travel distance or range of rotation/twist, applicant surprisingly discovered such torsion bars are suitable for adjustable seats and other objects where only 80-110 degrees of tension or rotation is required.

In some contemplated embodiments, a lift-assist system for an adjustable seat is provided including left and right side arms, and a hollow cross-member that extends there-between. An elongated torsion spring could be positioned within a lumen or hollow portion of the cross-member, and could have a thickness that is no greater than 10% of a length or the spring, and no great than 25% of a width of the spring. The elongated torsion spring could have a first portion that is attached or otherwise coupled to a first spring receiver (the first portion being movable or non-movable relative to the first spring receiver), and a second portion distinct from the first portion, wherein the second portion is attached or coupled to a second spring receiver (the second portion being movable or non-movable relative to the second spring receiver). Preferably the first portion and first spring receiver are coupled to the adjustable seat and seat frame in a manner such that it rotates or moves when the seat is moved (e.g., adjusted from a stowed configuration to a use configuration, or vice versa), while the second portion and second spring receiver are coupled to the adjustable seat and seat frame in a manner such that it does not rotate or move when the seat is moved. For example, the first spring receiver could be fixedly attached or coupled to a moving portion of the seat frame (e.g., a side arm or a cross-member, which rotates or otherwise moves when a seat is adjusted), and the second spring receiver could be fixedly attached or coupled to a non-moving portion of the seat frame (e.g., a leg or a sleeved structure, which does not rotate or other wise move when a seat is adjusted).

FIG. 1 is an exploded view of an exemplary lift-assist seat system 100 of the inventive subject matter. System 100 includes a rear leg 109 that is configured to attach to a wall, shower stall, or other structure via wall mount 111 and a set of fasteners (e.g., screws). Rear leg 109 is coupled to an adjustable rubber foot 109A that is screwed into leg 109, or otherwise coupled thereto, and is also coupled to a sleeve structure 107 that extends substantially perpendicularly to leg 109, and includes (a) a lumen sized and dimensioned to receive at least a portion of cross-member 129, and (b) an opening or slot 107A sized and dimensioned to receive at least a portion of a first spring retainer 119.

System 100 also includes a second rear leg 115, which is configured to attach to the wall or other structure via second wall mount 117 and a set of fasteners. Second rear leg 115 is similar or identical to rear leg 109, and is coupled to a second adjustable rubber foot, and a second sleeve structure 113 having a lumen sized and dimensioned to receive cross-member 129.

Upon assembly, cross-member 129 is placed through sleeve structure 107 and second sleeve structure 113, and is secured in place horizontally between first and second side arms 103 and 105, respectively, such that the slot 107A of sleeve structure 107 aligns with a slot or opening 129A of cross-member 129. First spring retainer 119 is then placed at least partially through the slot 107A of sleeve structure 107 and the slot or opening 129A of cross-member 129. In some embodiments, spring retainer 119 is permanently welded or otherwise coupled to sleeve structure 107 such that it does not rotate or move relative to one or both of leg 109 and sleeve structure 107. In these and some other embodiments, slot 129A could be oversized relative to first spring retainer 119 such that cross-member 129 is free to rotate within sleeve structure 107 (to an extent determined at least in part by the size of slot 129A) when seat 101 moves between stowed and use configurations.

Spring 133 is secured within a lumen of cross-member 129 such that at least first and second portions (e.g., end portions, non-end portions) of spring 133 are coupled with first spring retainer 119 and a second spring retainer 135, respectively. In some preferred embodiments, second spring retainer 135 is fixedly attached (e.g., welded) to one or both of second side arm 105 and cross-member 129, which move with seat 101 when seat 101 moves between stowed and use configurations. As first spring retainer is welded or otherwise non-movably coupled to sleeve structure 107, which does not move based on a movement of seat 101, the first and second portions of spring 133 adjust between being substantially parallel and non-substantially parallel to one another (when viewed from a right or left side of the seat) when the seat moves between stowed and use configurations.

As illustrated, spring 133 is an elongated, substantially flat torsion spring having a long and narrow cross-section (e.g., a rectangular cross-section having a height at least 5 times, at least 7 times, or even more than 10 times as great as a width). When seat 101 is in a stowed configuration, the first and second portions of spring 133 that couple with first and second spring retainers 119 and 135, respectively, are parallel to one another. Viewed from a different perspective, the longest cross-sectional length of the first portion is parallel to the longest cross-sectional length of the second portion when the spring is viewed from a right or left side of the seat in the stowed configuration. Viewed from yet another perspective, when the seat is in the stowed configuration, spring 133 is in an untwisted configuration.

When seat 101 is in a use configuration, the first and second portions of spring 133 that couple with first and second spring retainers 119 and 135, respectively, are no longer parallel to one another. For example, the first and second portions of spring 133 may be substantially perpendicular to one another. Viewed from a different perspective, the longest cross-sectional length of the first portion can be angled between 45-135 degrees relative to the longest cross-sectional length of the second portion when the spring is viewed from a right or left side of the seat in the use configuration. Viewed from yet another perspective, when the seat is in the use configuration, spring 133 could be in a twisted configuration (where the first portion extends vertically, and the second portion extends horizontally, or vice versa).

System 100 also includes first front leg 121, a third sleeve structure 121A, a second front leg 125, a fourth sleeve structure 125A, an optional cross-bar 123 that keeps first and second front legs 121 and 125 aligned with one another (side to side), and an optional second cross-bar 127 that keeps second front leg 125 and second rear leg 115 aligned with one another (front to back). Second cross-member 131 is passed through third sleeve structure 121A and fourth sleeve structure 125A, and secured between first and second side arms 103 and 105, respectively.

In some preferred embodiments, first cross-member 129 is attached to first and second side arms 103 and 105 such that first cross-member 129 does not rotate or otherwise move relative to first and second side arms 103 and 105. Where first and second rear legs 109 and 115 are configured to remain in their positions while at least one of first cross-member 129 first and second side arms 103 and 105 move, first cross-member 129 could rotate relative to first and second rear legs 109 and 115, and relative to first and second sleeve structures 107 and 113, when seat 101 moves between stowed and use configurations.

Similarly, in some embodiments second cross-member 131 is attached to first and second side arms 103 and 105 such that second cross-member 131 does not rotate or otherwise move relative to first and second side arms 103 and 105. Second cross-member 131 could rotate relative to first and second front legs 121 and 125, and relative to third and fourth sleeve structures 107A and 125A, when seat 101 moves between stowed and use configurations.

The first and second side arms 103 and 105 could advantageously couple to end caps, for example rubber end caps (e.g., 103A), that advantageously provide a layer of padding around portions of the rigid (e.g., stainless steel) side arms.

Figure 2B:
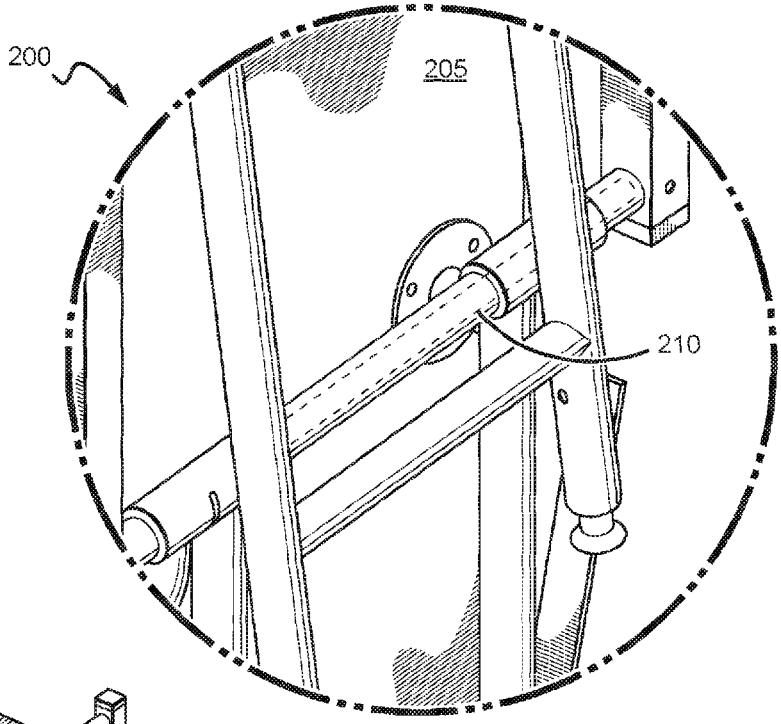
FIGS. 2A-2B illustrate a lift-assist adjustable seat system in a stowed configuration, the adjustable seat including a lift-assist system.
Figure 2A:
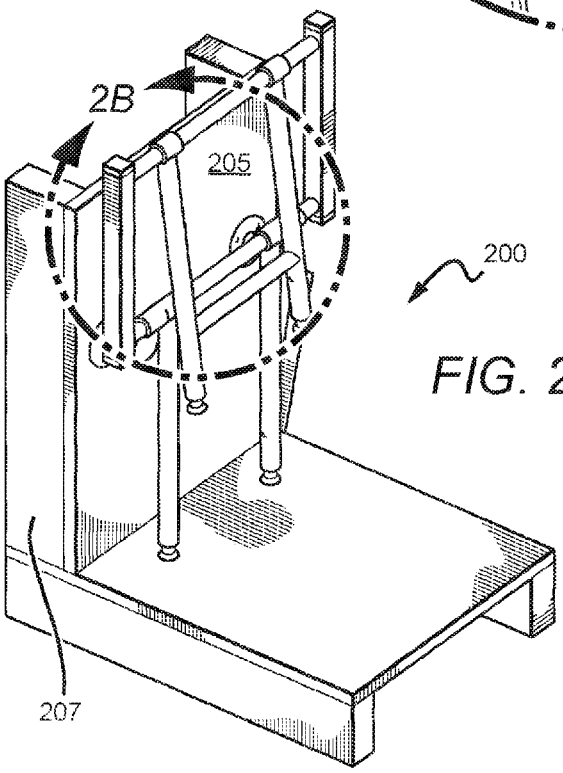
Figure 3B:
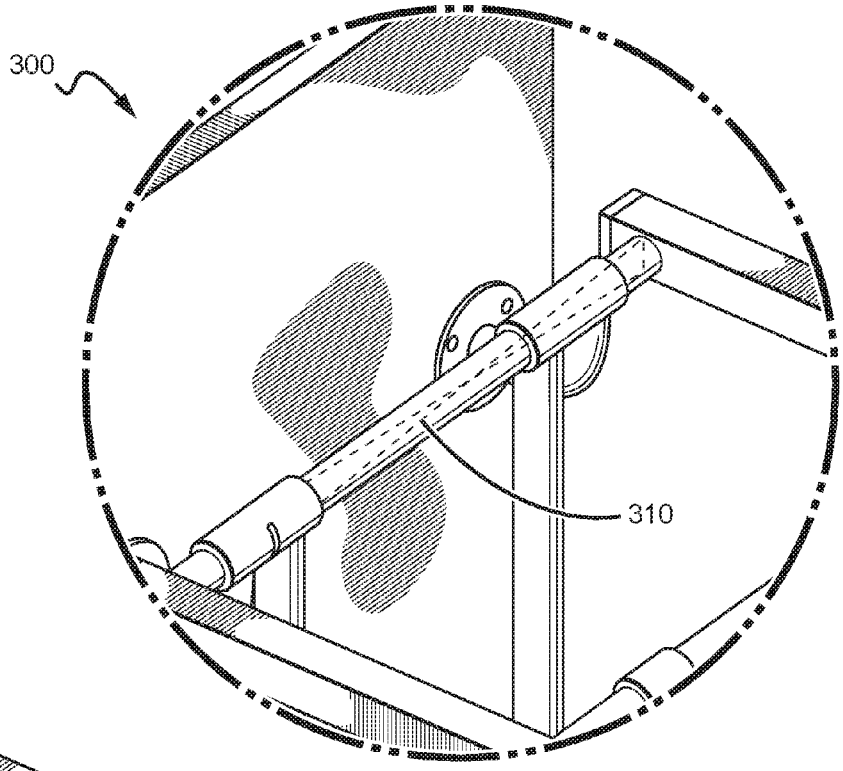
FIGS. 3A-3B illustrate a lift-assist adjustable seat system in a use configuration (with the seat itself removed), the adjustable seat including a lift-assist system.
Figure 3A:
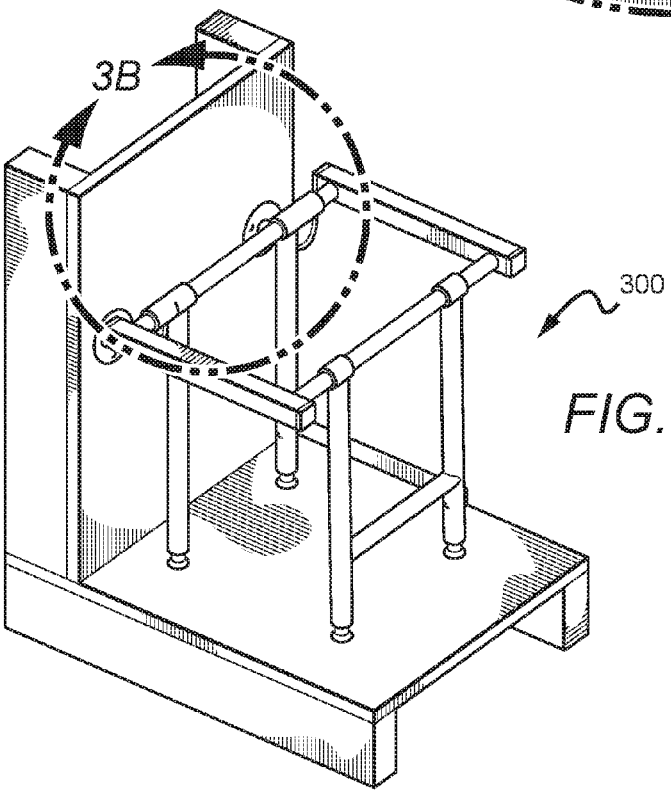

FIGS. 2A-2B illustrate another lift-assist seat system 200 similar to system 100, wherein the adjustable seat 205 is in a stowed configuration, and the seat 205 is substantially parallel to the wall 207 or other supporting structure. Enclosed spring 210 is shown in an untwisted and untensioned configuration. FIG. 3A-3B illustrate lift-assist seat system 300, which is identical to system 200 with the seat removed for illustrative purposes. When the adjustable seat would be in the use configuration (although removed from FIGS. 3A-3B), spring 310 twists approximately 90 degrees and is tensioned.

It should be appreciated that the lift-assist seat systems described above provide several benefits over known systems. The disclosed lift-assist seat systems not only reduce the perceived weight of the seat with an enclosed or substantially enclosed spring that is not readily noticeable or visible to a user, the system is adjustable and applicable to a wide range of various seat designs that may otherwise necessitate a different lift-assist system. Furthermore, the design of the elongated and substantially flat spring is cost-effective, highly durable, and easy to incorporate. Although there does not appear to be a better and more trouble-free lift-assist system than one including an enclosed, substantially flat spring that is welded to an internal portion of the seat frame and does not come into contact with user body parts, alternative lift-assist systems are contemplated and described below.

Figure 4B:
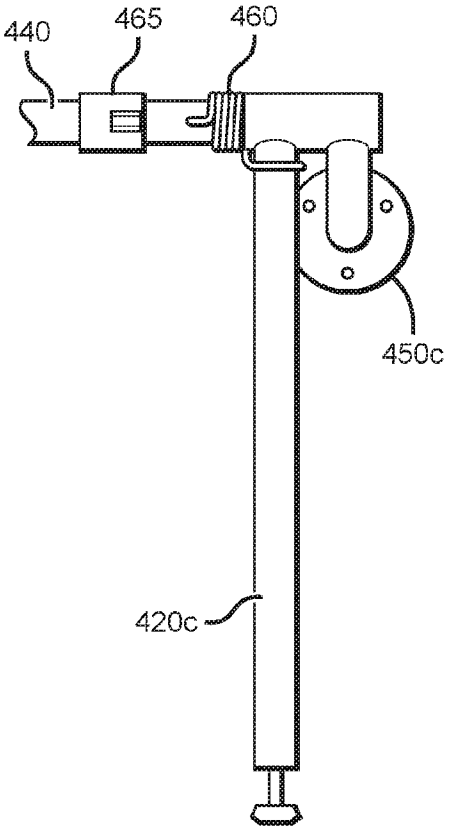
FIGS. 4A-4B illustrate an alternative lift-assist adjustable seat system that includes an external coil spring.
Figure 4A:
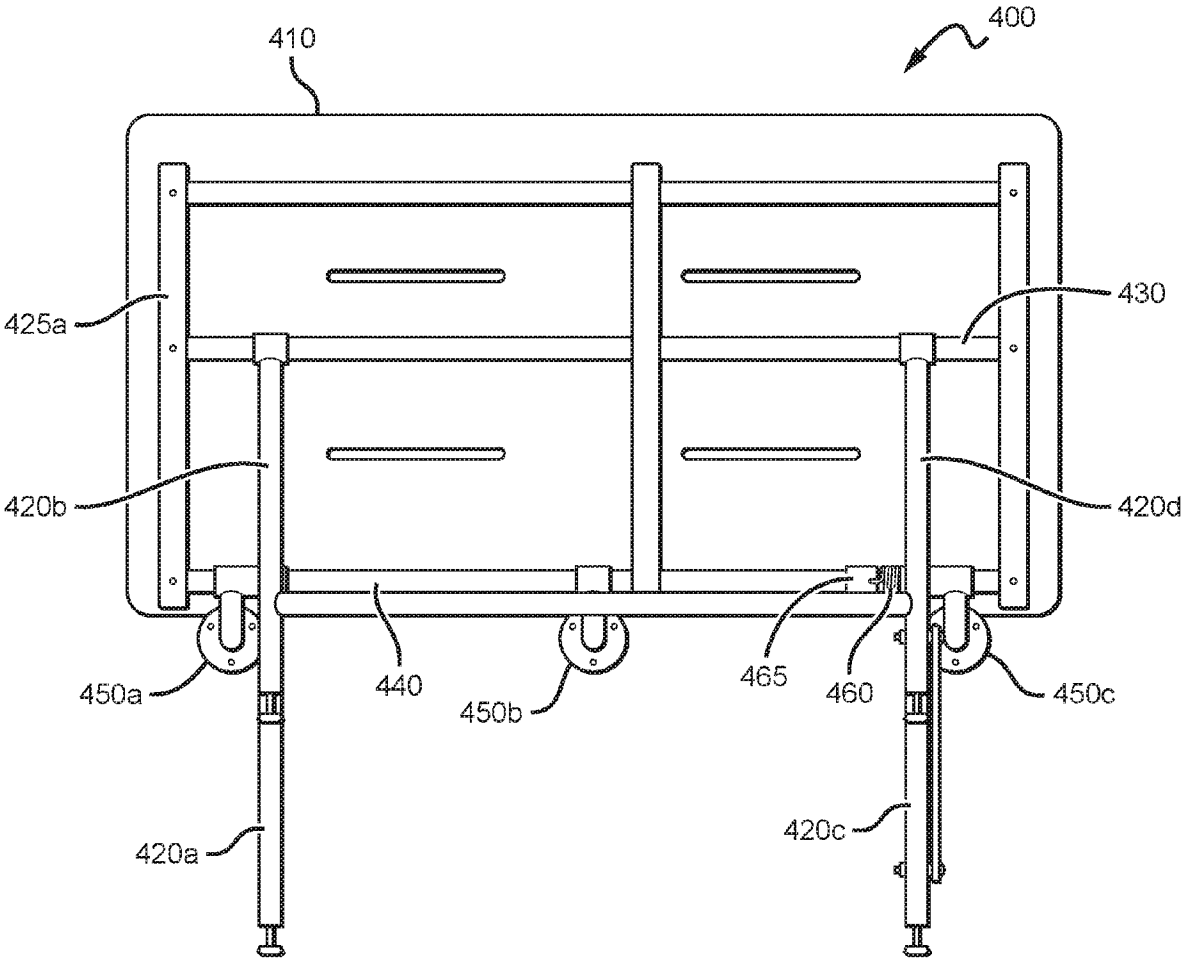

FIGS. 4A-4B illustrate an alternative lift-assist seat system 400 including an external coil spring. System 400 comprises a seat 410 coupled to a seat frame, the seat frame including side arms (e.g., 425*a*), cross-members (e.g., 430, 440) extending between the side arms, a pair of rear legs (420*a*, 420*c*), and a pair of front legs (420*b*, 420*d*). Wall mounts 450*a*, 450*b*, and 450*c* slidably couple with cross-member 440, and are secured to a wall or other supporting structure. A leg assembly, here a rear leg assembly, includes a coil spring lift-assist 460, and locking coupling 465, which is slidably coupled to cross-member 440. It should be appreciated that the coil spring lift-assist 460 could be incorporated in any of the systems shown and described in FIGS. 1-3. The coil spring lift-assist 460 could be provided in addition, or alternatively to, the enclosed substantially flat torsion spring.

Although external coil spring lift-assist systems could be used, and are contemplated herein, they may be less preferred in all uses. External coiled springs are generally adjustable, and therefore could be difficult to determine how a coiled spring could be implemented into objects that are required to hold a large amount of weight. Additionally, the coiled springs could be rather unsightly, and could lead to injuries from pinching, etc.

Figure 5A:
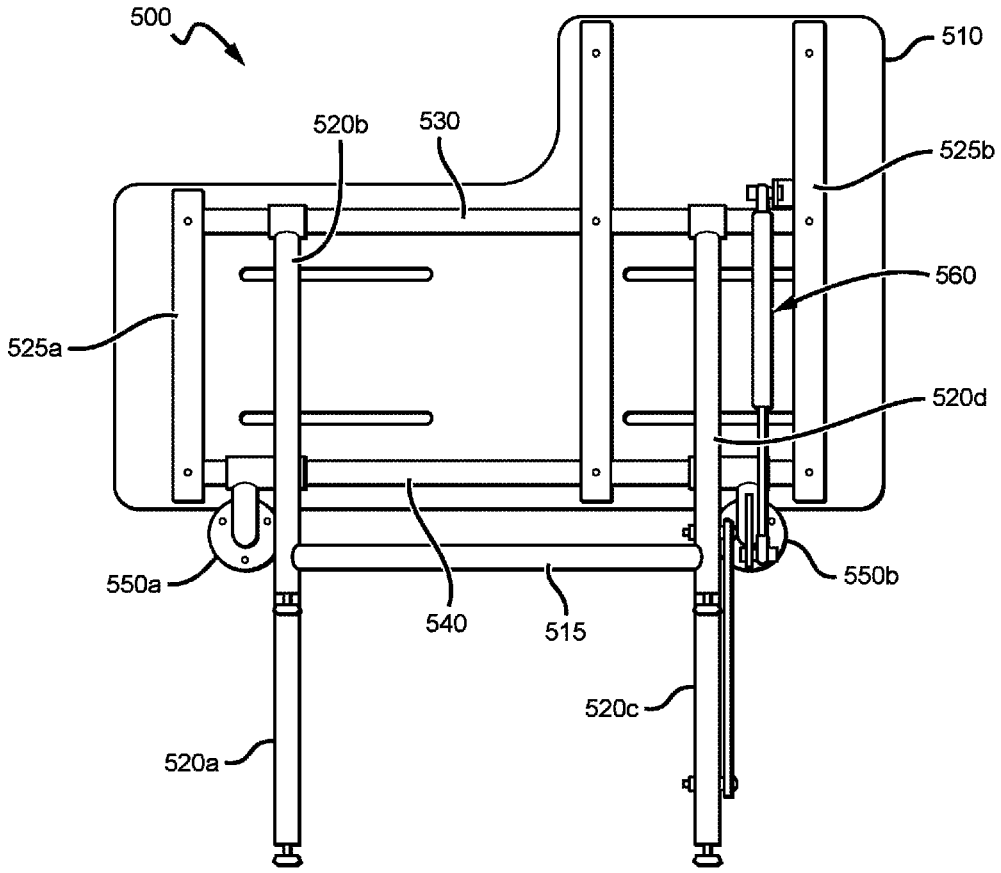
FIG. 5A-5C illustrate another alternative lift-assist adjustable seat system that includes hydraulic lift component.
Figure 5B:
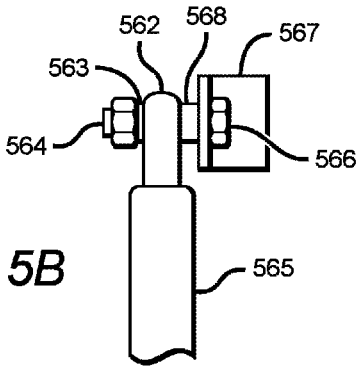

FIGS. 5A-5B illustrate yet another alternative seat system 500, which includes a seat 510, a seat frame including side arms (e.g., 525*a*, 525*b*), cross members (e.g., 530, 540), a pair of front legs (520*b*, 520*d*), a cross bar 515 extending between the pair of front legs, a pair of rear legs (520*a*, 520*c*), and wall mounts 550*a*, 550*b*. System 500 further includes a hydraulic shock assist, generally referred to as 560.

Figure 5C:
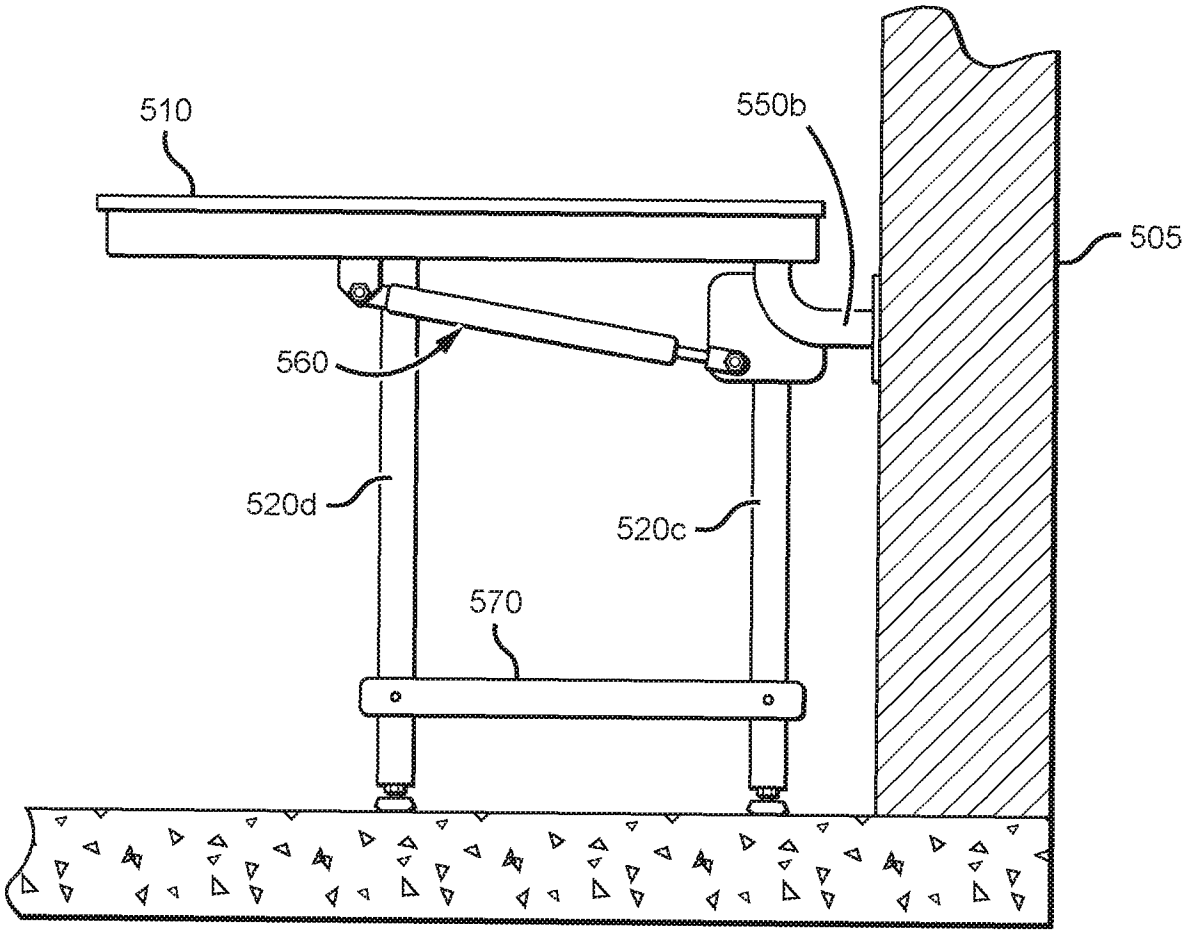

As shown in FIG. 5B's detailed view, the hydraulic shock assist 560 includes a hydraulic connector 565, coupled with a hinge eye thread 562, a washer 563, a spacer 568, a hex bolt 566, a welded bracket 567, and a lock nut 564. Such a shock assist system (similar to those seen in tailgates of trucks) could regulate the drop rate of the seat it is coupled to. As shown in FIG. 5C's side view, rear leg 520*c*, is coupled with front leg 520*d* via a cross-bar 570. Additionally, system 500 is attached to a wall 505 or other structure via wall mounts (e.g., 550*b*).

Although hydraulic lifts could be used, and are contemplated herein, it should be appreciated that such lifts are generally not preferred as they are extremely costly compared to enclosed substantially flat torsion spring systems, they are non-adjustable, and have many moving parts that will almost certainly wear out and fail at some point in time.

Figure 6A:
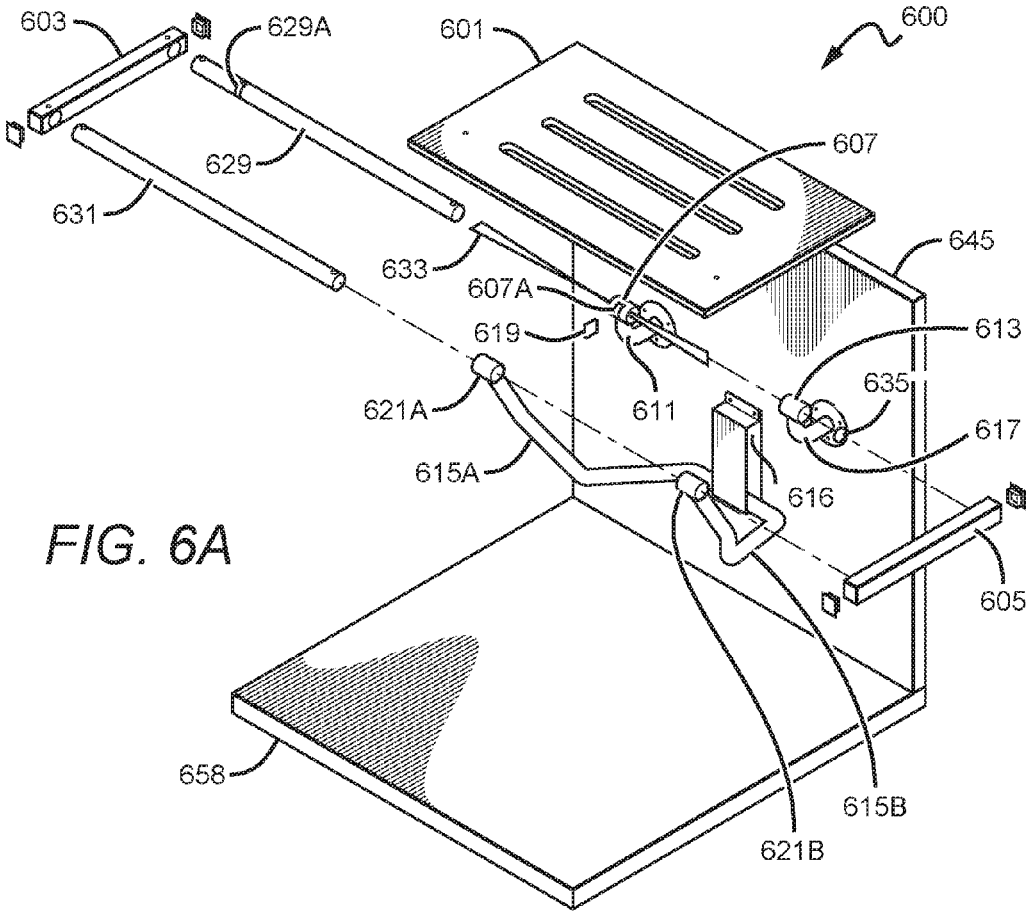
FIG. 6A illustrates an exploded view of another lift-assist adjustable seat system that is wall mounted, and includes an enclosed torsion spring lift-assist system.
Figure 6B:
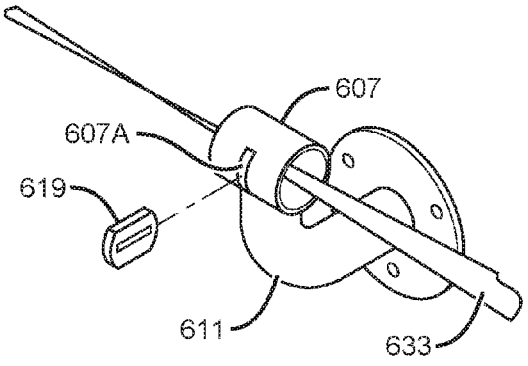
FIGS. 6B-6C are exploded views of portions of the enclosed torsion spring lift-assist system of FIG. 6A.
Figure 6C:
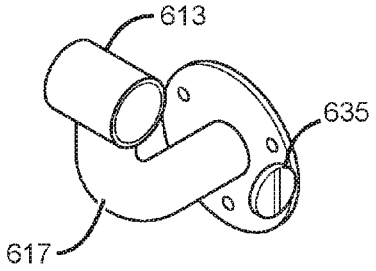

FIGS. 6A-6C are exploded views of an exemplary yoke style lift-assist seat system 600 of the inventive subject matter. System 600 is almost identical to system 100 described above. However, a yoke style frame/support is provided rather than the rear and front legs that are configured to contact the floor (e.g., 658) when the seat is used.

System 600 includes a yoke slider 616, which is configured to mount to wall 645. Yoke slider is sized and dimensioned to receive a central portion of a yoke that includes a first and second yoke end portions (615A, 615B, respectively), positioned on opposite sides of yoke slider 616. When the seat is adjusted between stowed and use configurations, the central portion of the yoke could move vertically (up and down) along the height of the yoke slider 616.

The first yoke end portion 615A includes or is coupled to a first sleeve structure 621A, and second yoke end portion 615B includes or is coupled to a second sleeve structure 621B. The first and second sleeve structures are each sized and dimensioned to receive at least a portion of a first cross-member 631 that extends between first side arm 603 and second side arm 605.

System 600 also includes a first wall mount extension 611 including or coupled to a third sleeve structure 607, and a second wall mount extension 617 including or coupled to a fourth sleeve structure 613. As best illustrated in FIG. 6B, the third sleeve structure 607 includes (a) a lumen sized and dimensioned to receive at least a portion of cross-member 629, and (b) an opening or slot 607A sized and dimensioned to receive at least a portion of a first spring retainer 619.

As best illustrated in FIG. 6C, a second spring retainer 635 is provided that is configured to fixedly attach to at least one of fourth sleeve structure 613 and second side arm 605. The third and fourth sleeve structures 607 and 613, respectively, each include a lumen sized and dimensioned to receive at least a portion of a second cross-member 629 that extends between first side arm 603 and second side arm 605. Second cross-member 629 includes a slot 629A, which is sized and dimensioned to (a) align with slot or opening 607A of third sleeve structure 607, and (b) receive at least a portion of first spring retainer 619. An elongated and substantially flat torsion spring 633 can advantageously be retained between first and second spring retainers 619 and 635, respectively. First and second spring retainers 619 and 635 could each include a notch or through-hole or other opening sized and dimensioned to removably receive and secure portions of the spring. Additionally or alternatively, first and second spring retainers 619 and 635 could be permanently attached to first and second end portions of spring 633.

Upon assembly, cross-member 629 is placed through third sleeve structure 607 and fourth sleeve structure 613, and is secured in place horizontally between first and second side arms 603 and 605, respectively, such that the slot 607A of sleeve structure 607 aligns with a slot or opening 629A of cross-member 629. First spring retainer 619 is then placed at least partially through the slot 607A of sleeve structure 607 and the slot or opening 629A of cross-member 629. In some embodiments, first spring retainer 619 is permanently welded or otherwise coupled to sleeve structure 607 such that it does not rotate or move relative to sleeve structure 607. In these and some other embodiments, slot 629A could be oversized relative to first spring retainer 619 such that cross-member 629 is free to rotate within sleeve structure 607 (to an extent determined at least in part by the size of slot 629A) when seat 601 moves between stowed and use configurations.

Spring 633 is secured within a lumen of cross-member 629 such that at least first and second portions (e.g., end portions, non-end portions) of spring 633 are coupled with first spring retainer 619 and a second spring retainer 635, respectively. In some preferred embodiments, second spring retainer 635 is non-rotatably attached (e.g., welded) to one or both of second side arm 605 and cross-member 629, which move with seat 601 when seat 601 moves between stowed and use configurations. As first spring retainer is welded or otherwise non-movably coupled to sleeve structure 607, which does not move based on a movement of seat 601, the first and second portions of spring 633 adjust between being substantially parallel and non-substantially parallel to one another (when viewed from a right or left side of the seat) when the seat moves between stowed and use configurations.

As illustrated, spring 633 is an elongated, substantially flat torsion spring having a long and narrow cross-section (e.g., a rectangular cross-section having a height at least 5 times, at least 7 times, or even more than 10 times as great as a width). When seat 601 is in a stowed configuration, the first and second portions of spring 633 that couple with first and second spring retainers 619 and 635, respectively, are parallel to one another. Viewed from a different perspective, the longest cross-sectional length of the first portion is parallel to the longest cross-sectional length of the second portion when the spring is viewed from a right or left side of the seat in the stowed configuration. Viewed from yet another perspective, when the seat is in the stowed configuration, spring 633 is in an untwisted configuration.

When seat 601 is in a use configuration, the first and second portions of spring 633 that couple with first and second spring retainers 619 and 635, respectively, are no longer parallel to one another. For example, the first and second portions of spring 633 may be substantially perpendicular to one another. Viewed from a different perspective, the longest cross-sectional length of the first portion can be angled between 45-135 degrees relative to the longest cross-sectional length of the second portion when the spring is viewed from a right or left side of the seat in the use configuration. Viewed from yet another perspective, when the seat is in the use configuration, spring 633 could be in a twisted configuration (where the first portion extends vertically, and the second portion extends horizontally, or vice versa).

The disclosure herein is largely directed to adjustable seats. However, it should be appreciated that the springs of the inventive subject matter could be used on any commercially suitable adjustable objects. Additionally, although the disclosure herein is largely directed to springs that are untwisted when the adjustable seat is in a stowed configuration, it should be appreciated that some contemplated springs could be untwisted when the adjustable object is in a use configuration, and twisted when the adjustable object is in a stowed configuration.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Thus, specific compositions and methods of lift assist systems and lift assist seat systems have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A lift-assist system for an adjustable seat, comprising:

a movable seat frame comprising a first side arm, a second side arm, and a cross-member that extends between the first and second side arms;

an elongated torsion spring positioned within a lumen of the cross-member, the elongated torsion spring having a first portion and a second portion different from the first portion; and a first sleeve structure, wherein the first sleeve structure comprises a second lumen sized and dimensioned to enclose at least a portion of the cross-member;

wherein the adjustable seat is configured such that when the adjustable seat moves between first and second different configurations, the first portion of the elongated torsion spring is rotated relative to the second portion, thereby causing the elongated torsion spring to twist;

wherein the cross-member includes a first slot, wherein a spring retainer is positioned at least partially through the first slot such that at least a portion of the spring retainer is positioned within the lumen of the cross-member, and wherein the first portion of the elongated torsion spring is coupled to the at least the portion of the spring retainer positioned within the lumen of the cross-member; and wherein the first sleeve structure comprises a second slot that aligns with the first slot, and wherein the spring retainer is fixedly coupled to the first sleeve structure via the second slot.

2. The lift-assist system of claim 1, wherein the spring retainer is configured to move along a length of the first slot when the adjustable seat moves between the first and second different configurations.

3. The lift-assist system of claim 1, wherein the cross-member extends substantially perpendicularly to at least one of the first side arm and the second side arm.

4. The lift-assist system of claim 1, wherein the elongated torsion spring comprises a substantially flat, tempered steel spring.

5. The lift-assist system of claim 1, wherein the spring retainer is welded to the first sleeve structure, and wherein the at least the portion of the cross-member is configured to rotate relative to the first sleeve structure such that the spring retainer moves along the length of the first slot.

6. The lift-assist system of claim 1, wherein the elongated torsion spring comprises an elongated rectangular prism having a thickness of between 0.25 inch and 1 inch, inclusive.

7. The lift-assist system of claim 2, further comprising a first wall mount extension including or coupled to a first sleeve structure.

8. The lift-assist system of claim 7, wherein the spring retainer is welded to the first sleeve structure, and wherein the at least the portion of the cross-member is configured to rotate relative to the first sleeve structure such that the spring retainer moves along the length of the first slot.

9. The lift-assist system of claim 7, wherein the elongated torsion spring comprises an elongated rectangular prism having a thickness of between 0.25 inch and 1 inch, inclusive.

* * * * *